US009965928B2

(12) United States Patent
Green

(10) Patent No.: US 9,965,928 B2
(45) Date of Patent: May 8, 2018

(54) SYSTEM AND METHOD FOR DISPLAYING MESSAGES IN A COLUMN-BY-COLUMN FORMAT VIA AN ARRAY OF LEDS CONNECTED TO A CIRCUIT OF A COMPRESSOR

(71) Applicant: Emerson Electric Co., St. Louis, MO (US)

(72) Inventor: Charles E. Green, Fenton, MO (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days. days.

(21) Appl. No.: 15/430,978

(22) Filed: Feb. 13, 2017

(65) Prior Publication Data

US 2017/0301192 A1 Oct. 19, 2017

Related U.S. Application Data

(60) Provisional application No. 62/323,519, filed on Apr. 15, 2016.

(51) Int. Cl.
*G08B 21/00* (2006.01)
*G08B 5/36* (2006.01)
(Continued)

(52) U.S. Cl.
CPC ..... *G08B 5/36* (2013.01); *G08B 21/187* (2013.01); *G09G 3/14* (2013.01); *G09G 2330/02* (2013.01)

(58) Field of Classification Search
CPC ..... G08B 5/36; G08B 21/187; G09B 3/14; G09G 2330/02
(Continued)

(56) References Cited

U.S. PATENT DOCUMENTS 4,388,578 A 6/1983 Green et al.
4,437,146 A 3/1984 Carpenter
(Continued)

FOREIGN PATENT DOCUMENTS

EP 0744816 A2 11/1996
EP 1641113 A1 3/2006
(Continued)

OTHER PUBLICATIONS

International Search Report regarding International Application No. PCT/US2017/027691, dated Aug. 18, 2017.
(Continued)

*Primary Examiner* — Ojiako Nwugo

(57) ABSTRACT

An indication system is provided and includes evaluation, messaging, and display modules and a display. The evaluation module generates a message based on a parameter of a compressor or a drive. The messaging module: generates a message based on the parameter; generates a string of glyphs based on the message; selects a predetermined number of glyphs in the string of glyphs; generates column data for the selected glyphs; and generates packets including the column data. The display module generates output signals based on the packets. The display includes an array of LEDs, does not include a transistor, and illuminates the LEDs based on the output signals. The display module is configured to generate the output signals to illuminate one or more of the LEDS in a column-by-column format, such that power is only provided to one column of the array of LEDs at any moment in time.

20 Claims, 8 Drawing Sheets

(51) Int. Cl.
*G08B 21/18* (2006.01)
*G09G 3/14* (2006.01)

(58) Field of Classification Search
USPC ..... 340/648; 345/442
See application file for complete search history.

(56) References Cited

U.S. PATENT DOCUMENTS

| | | | | |
|---|---|---|---|---|
| 4,504,922 | A | 3/1985 | Johnson et al. | |
| 4,939,473 | A | 7/1990 | Eno | |
| 5,367,617 | A * | 11/1994 | Goossen | G06F 17/17 345/442 |
| 5,410,360 | A | 4/1995 | Montgomery | |
| 6,115,051 | A * | 9/2000 | Simons | G06T 11/203 345/442 |
| 6,515,437 | B1 | 2/2003 | Zinkler et al. | |
| 6,593,881 | B2 | 7/2003 | Vail et al. | |
| 6,902,117 | B1 | 6/2005 | Rosen | |
| 7,903,441 | B2 | 3/2011 | Chen et al. | |
| 7,952,293 | B2 | 5/2011 | Kelly | |
| 8,264,860 | B2 | 9/2012 | Green | |
| 8,432,108 | B2 | 4/2013 | Kelly et al. | |
| 9,070,224 | B1 * | 6/2015 | Esfahbod MirHosseinZadeh Sarabi | G06T 11/203 |
| 9,300,241 | B2 | 3/2016 | Becerra et al. | |
| 9,564,848 | B2 | 2/2017 | Ishizeki et al. | |
| 9,787,175 | B2 | 10/2017 | Phadke | |
| 2002/0085468 | A1 | 7/2002 | Kobayashi | |
| 2003/0117818 | A1 | 6/2003 | Ota | |
| 2004/0136208 | A1 | 7/2004 | Agarwal et al. | |
| 2005/0028539 | A1 | 2/2005 | Singh et al. | |
| 2005/0068337 | A1 * | 3/2005 | Duarte | G06F 1/162 345/649 |
| 2005/0076659 | A1 | 4/2005 | Wallace et al. | |
| 2005/0109047 | A1 | 5/2005 | Park et al. | |
| 2005/0122082 | A1 | 6/2005 | Eckardt | |
| 2007/0036212 | A1 | 2/2007 | Leung et al. | |
| 2008/0104983 | A1 | 5/2008 | Yamai et al. | |
| 2008/0122418 | A1 | 5/2008 | Briere et al. | |
| 2008/0310201 | A1 | 12/2008 | Maksimovic | |
| 2009/0273297 | A1 | 11/2009 | Kelly | |
| 2010/0117545 | A1 | 5/2010 | Kelly et al. | |
| 2010/0253295 | A1 | 10/2010 | Tan et al. | |
| 2011/0012526 | A1 | 1/2011 | Kelly | |
| 2011/0031920 | A1 | 2/2011 | Henderson et al. | |
| 2011/0031943 | A1 | 2/2011 | Green | |
| 2011/0034176 | A1 * | 2/2011 | Lord | G06F 17/30244 455/450 |
| 2011/0164339 | A1 | 7/2011 | Schmid et al. | |
| 2011/0205161 | A1 * | 8/2011 | Myers | G06F 3/016 345/169 |
| 2012/0075310 | A1 * | 3/2012 | Michail | G06T 11/203 345/442 |
| 2012/0179299 | A1 | 7/2012 | Gyota et al. | |
| 2012/0313646 | A1 | 12/2012 | Nishikawa | |
| 2013/0010508 | A1 | 1/2013 | Courtel | |
| 2013/0020310 | A1 | 1/2013 | Hacham | |
| 2014/0169046 | A1 | 6/2014 | Chen | |
| 2014/0292212 | A1 | 10/2014 | Gray et al. | |
| 2015/0214833 | A1 | 7/2015 | Ramabhadran et al. | |
| 2015/0229204 | A1 | 8/2015 | Mao et al. | |
| 2015/0236581 | A1 | 8/2015 | Chen et al. | |
| 2015/0326107 | A1 | 11/2015 | Hsiao et al. | |
| 2015/0333633 | A1 | 11/2015 | Chen et al. | |
| 2015/0354870 | A1 | 12/2015 | Lee et al. | |
| 2015/0365034 | A1 | 12/2015 | Marcinkiewicz et al. | |
| 2016/0043632 | A1 | 2/2016 | Tomioka | |
| 2016/0043633 | A1 | 2/2016 | Phadke | |
| 2016/0218624 | A1 | 7/2016 | Ishizeki et al. | |
| 2016/0248365 | A1 | 8/2016 | Ishizeki et al. | |
| 2016/0329716 | A1 | 11/2016 | Inoue | |
| 2017/0299444 | A1 | 10/2017 | Green | |
| 2017/0300107 | A1 | 10/2017 | Green et al. | |
| 2017/0302158 | A1 | 10/2017 | Green | |
| 2017/0302159 | A1 | 10/2017 | Green et al. | |
| 2017/0302160 | A1 | 10/2017 | Marcinkiewicz et al. | |
| 2017/0302161 | A1 | 10/2017 | Green | |
| 2017/0302162 | A1 | 10/2017 | Green | |
| 2017/0302165 | A1 | 10/2017 | Marcinkiewicz et al. | |
| 2017/0302200 | A1 | 10/2017 | Marcinkiewicz | |
| 2017/0302212 | A1 | 10/2017 | Marcinkiewicz et al. | |
| 2017/0302214 | A1 | 10/2017 | Marcinkiewicz et al. | |

FOREIGN PATENT DOCUMENTS

| | | | |
|---|---|---|---|
| JP | H11237427 | A | 8/1999 |
| JP | 2006134607 | A | 5/2006 |
| JP | 2010541256 | A | 12/2010 |
| JP | 2011160508 | A | 8/2011 |
| JP | 2015080316 | A | 4/2015 |
| KR | 20040025420 | A | 3/2004 |
| KR | 20130067440 | A | 6/2013 |
| WO | WO-2007035407 | A1 | 3/2007 |
| WO | WO-2010143239 | A1 | 12/2010 |
| WO | WO-2011074972 | A1 | 6/2011 |

OTHER PUBLICATIONS

Written Opinion of the International Searching Authority regarding International Application No. PCT/US2017/027691, dated Aug. 18, 2017.

International Search Report regarding International Application No. PCT/US2017/027744, dated Aug. 18, 2017.

Written Opinion of the International Searching Authority regarding International Application No. PCT/US2017/027744, dated Aug. 18, 2017.

International Search Report regarding International Application No. PCT/US2017/027738, dated Aug. 18, 2017.

Written Opinion of the International Searching Authority regarding International Application No. PCT/US2017/027738, dated Aug. 18, 2017.

Office Action regarding U.S. Appl. No. 15/419,394, dated Sep. 11, 2017.

International Search Report regarding International Application No. PCT/US2017/027710, dated Sep. 20, 2017.

Written Opinion of the International Searching Authority regarding International Application No. PCT/US2017/027710, dated Sep. 20, 2017.

Amit Kumar Sinha et al. "SEPIC Based PFC Converter for PMBLDCM Drive in Air Conditioning System." International Journal of Advanced Computer Research, vol. 3, No. 1, Issue 8. Mar. 2013.

International Search Report regarding International Application No. PCT/US2017/027721, dated Sep. 20, 2017.

Written Opinion of the International Searching Authority regarding International Application No. PCT/US2017/027721, dated Sep. 20, 2017.

International Search Report regarding International Application No. PCT/US2017/027699, dated Sep. 20, 2017.

Written Opinion of the International Searching Authority regarding International Application No. PCT/US2017/027699, dated Sep. 20, 2017.

International Search Report regarding International Application No. PCT/US2017/027726, dated Sep. 12, 2017.

Written Opinion of the International Searching Authority regarding International Application No. PCT/US2017/027726, dated Sep. 12, 2017.

International Search Report regarding International Application No. PCT/US2017/027729, dated Sep. 13, 2017.

Written Opinion of the International Searching Authority regarding International Application No. PCT/US2017/027729, dated Sep. 13, 2017.

Applicant-Initiated Interview Summary regarding U.S. Appl. No. 15/419,394, dated Oct. 30, 2017.

Office Action regarding U.S. Appl. No. 15/419,394, dated Dec. 7, 2017.

Office Action regarding U.S. Appl. 15/419,464 dated Dec. 29, 2017.

(56) References Cited

OTHER PUBLICATIONS

Office Action regarding U.S. Appl. No. 15/419,423 dated Jan. 8, 2018.
Office Action regarding U.S. Appl. No. 15/487,201 dated Jan. 9, 2018.
Interview Summary regarding U.S. Appl. No. 15/419,394 dated Jan. 29, 2018.

* cited by examiner

SYSTEM AND METHOD FOR DISPLAYING MESSAGES IN A COLUMN-BY-COLUMN FORMAT VIA AN ARRAY OF LEDS CONNECTED TO A CIRCUIT OF A COMPRESSOR

CROSS-REFERENCE TO RELATED APPLICATIONS

This application claims the benefit of U.S. Provisional Application No. 62/323,519, filed on Apr. 15, 2016. The entire disclosure of the application referenced above is incorporated herein by reference.

FIELD

The present disclosure relates to systems for displaying messages with respect to compressor system operation.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Compressors are used in a wide variety of industrial and residential applications including, but not limited to, heating, ventilating, and air conditioning (HVAC) systems. Electric motors are used to power and/or actuate elements of the compressors. A control system for controlling operation of an electric motor of a compressor can include a drive. The drive can include: a power factor correction (PFC) circuit; filters, such as an electromagnetic interference (EMI) filter and a direct current filter; an inverter power circuit; a processor; and other circuit components.

The power factor correction (PFC) circuit provides a power factor correction between an inputted alternating current (AC) and a generated direct current (DC). A power factor is an indicator of a relationship between current and voltage in a circuit, or how effectively a circuit uses real power as compared to reactive power, which is stored and returned to a power source. A power factor can be expressed as a value between zero and one. A power factor can be equal to a ratio of actual electrical power dissipated by a circuit relative to a product of root mean squared (RMS) values of current and voltage for the circuit. The power factor approaches 1 as this ratio increases. The PFC circuit can be implemented to increase a power factor of a drive, thereby increasing an amount of real power used by the circuit as compared with an amount of reactive power the circuit stores and returns to the power source.

The inverter power circuit may convert DC power to AC power (e.g., 3-phase AC power) to drive a motor of the compressor. The processor controls operation of the drive including operation of the PFC circuit and the inverter power circuit.

SUMMARY

An indication system is provided and includes an evaluation module, a messaging module, a display module and a display. The evaluation module is configured to generate a message based on a parameter of a compressor or a drive of the compressor. The messaging module is configured to: generate a first message based on the parameter; generate a string of glyphs based on the first message; select a predetermined number of glyphs in the string of glyphs; generate column data for the selected predetermined number of glyphs; and generate packets including the column data. The display module is configured to (i) receive the packets via an interface, and (ii) generate output signals based on the packets. The display includes an array of light emitting diodes (LEDs). The display does not include a transistor. The display is configured to receive the output signals and illuminate the LEDs of the display based on the output signals. The display module is configured to generate the output signal to illuminate one or more of the LEDS of the display in a column-by-column format, such that power is only provided to one column of the array of LEDs at any moment in time.

In other features, a method of operating an indication system is provided. The method includes: generating a message based on a parameter of a compressor or a drive of the compressor; generating a first message based on the parameter at a messaging module; generating a string of glyphs based on the first message; selecting a predetermined number of glyphs in the string of glyphs; generating column data for the selected predetermined number of glyphs; and generating packets including the column data. The method further includes: receiving the packets at a display module via an interface; generating output signals based on the packets; and receiving the output signals at a display and illuminating an array of LEDs of the display based on the output signals, where the display does not include a transistor. The output signals are generated to illuminate one or more of the LEDS of the display in a column-by-column format, such that power is only provided to one column of the array of LEDs at any moment in time.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

In the drawings, reference numbers may be reused to identify similar and/or identical elements.

DESCRIPTION

Refrigeration System

Figure 1:
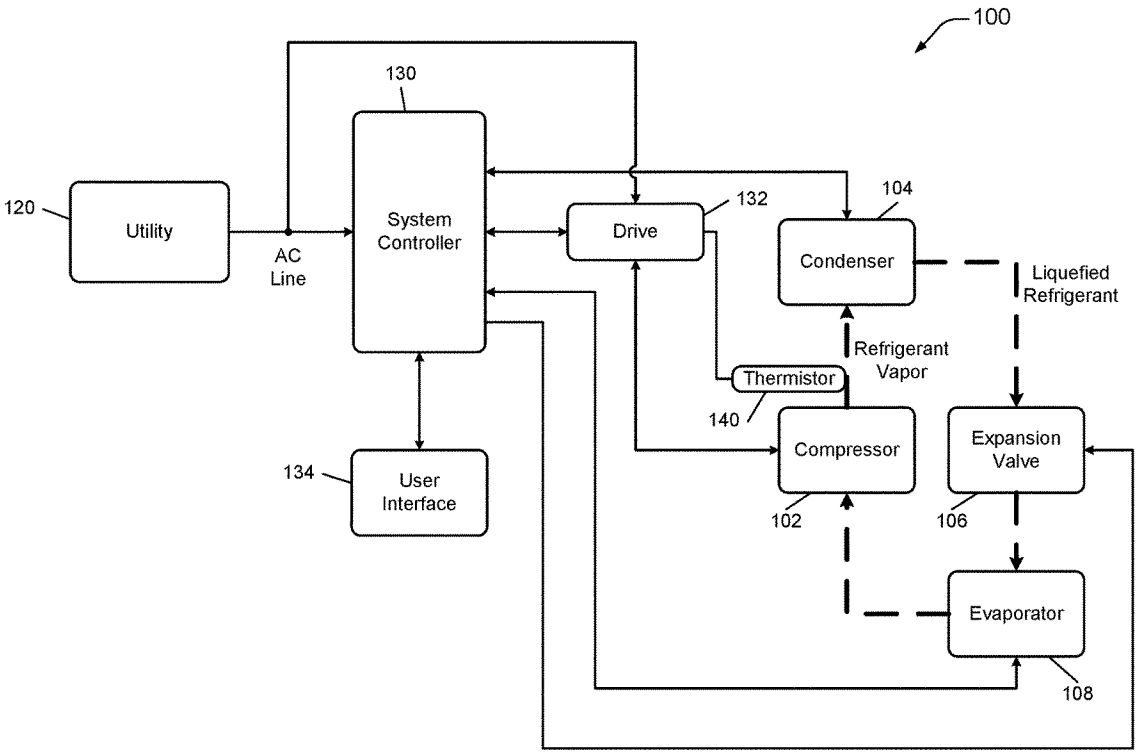
FIG. 1 is a functional block diagram of an example refrigeration system.

FIG. 1 is a functional block diagram of an example refrigeration system 100 including a compressor 102, a condenser 104, an expansion valve 106, and an evaporator 108. According to the principles of the present disclosure, the refrigeration system 100 may include additional and/or alternative components, such as a reversing valve or a filter-drier. In addition, the present disclosure is applicable to other types of refrigeration systems including, but not limited to, heating, ventilating, and air conditioning (HVAC), heat pump, refrigeration, and chiller systems.

The compressor 102 receives refrigerant in vapor form and compresses the refrigerant. The compressor 102 provides pressurized refrigerant in vapor form to the condenser 104. The compressor 102 includes an electric motor that drives a pump. For example only, the pump of the compressor 102 may include a scroll compressor and/or a reciprocating compressor.

All or a portion of the pressurized refrigerant is converted into liquid form within the condenser 104. The condenser 104 transfers heat away from the refrigerant, thereby cooling the refrigerant. When the refrigerant vapor is cooled to a temperature that is less than a saturation temperature, the refrigerant transforms into a liquid (or liquefied) refrigerant. The condenser 104 may include an electric fan that increases the rate of heat transfer away from the refrigerant.

The condenser 104 provides the refrigerant to the evaporator 108 via the expansion valve 106. The expansion valve 106 controls the flow rate at which the refrigerant is supplied to the evaporator 108. The expansion valve 106 may include a thermostatic expansion valve or may be controlled electronically by, for example, a system controller 130. A pressure drop caused by the expansion valve 106 may cause a portion of the liquefied refrigerant to transform back into the vapor form. In this manner, the evaporator 108 may receive a mixture of refrigerant vapor and liquefied refrigerant.

The refrigerant absorbs heat in the evaporator 108. Liquid refrigerant transitions into vapor form when warmed to a temperature that is greater than the saturation temperature of the refrigerant. The evaporator 108 may include an electric fan that increases the rate of heat transfer to the refrigerant.

A utility 120 provides power to the refrigeration system 100. For example only, the utility 120 may provide single-phase alternating current (AC) power at approximately 230 Volts root mean squared ($V_{RMS}$). In other implementations, the utility 120 may provide three-phase AC power at approximately 400 $V_{RMS}$, 480 $V_{RMS}$, or 600 $V_{RMS}$ at a line frequency of, for example, 50 or 60 Hz. When the three-phase AC power is nominally 600 $V_{RMS}$, the actual available voltage of the power may be 575 $V_{RMS}$.

The utility 120 may provide the AC power to the system controller 130 via an AC line, which includes two or more conductors. The AC power may also be provided to a drive 132 via the AC line. The system controller 130 controls the refrigeration system 100. For example only, the system controller 130 may control the refrigeration system 100 based on user inputs and/or parameters measured by various sensors (not shown). The sensors may include pressure sensors, temperature sensors, current sensors, voltage sensors, etc. The sensors may also include feedback information from the drive control, such as motor currents or torque, over a serial data bus or other suitable data buses.

A user interface 134 provides user inputs to the system controller 130. The user interface 134 may additionally or alternatively provide the user inputs directly to the drive 132. The user inputs may include, for example, a desired temperature, requests regarding operation of a fan (e.g., a request for continuous operation of the evaporator fan), and/or other suitable inputs. The user interface 134 may take the form of a thermostat, and some or all functions of the system controller (including, for example, actuating a heat source) may be incorporated into the thermostat.

The system controller 130 may control operation of the fan of the condenser 104, the fan of the evaporator 108, and the expansion valve 106. The drive 132 may control the compressor 102 based on commands from the system controller 130. For example only, the system controller 130 may instruct the drive 132 to operate the motor of the compressor 102 at a certain speed or to operate the compressor 102 at a certain capacity. In various implementations, the drive 132 may also control the condenser fan.

A thermistor 140 is thermally coupled to the refrigerant line exiting the compressor 102 that conveys refrigerant vapor to the condenser 104. The variable resistance of the thermistor 140 therefore varies with the discharge line temperature (DLT) of the compressor 102. As described in more detail, the drive 132 monitors the resistance of the thermistor 140 to determine the temperature of the refrigerant exiting the compressor 102.

The DLT may be used to control the compressor 102, such as by varying capacity of the compressor 102, and may also be used to detect a fault. For example, if the DLT exceeds the threshold, the drive 132 may power down the compressor 102 to prevent damage to the compressor 102.

Drive

Figure 2:
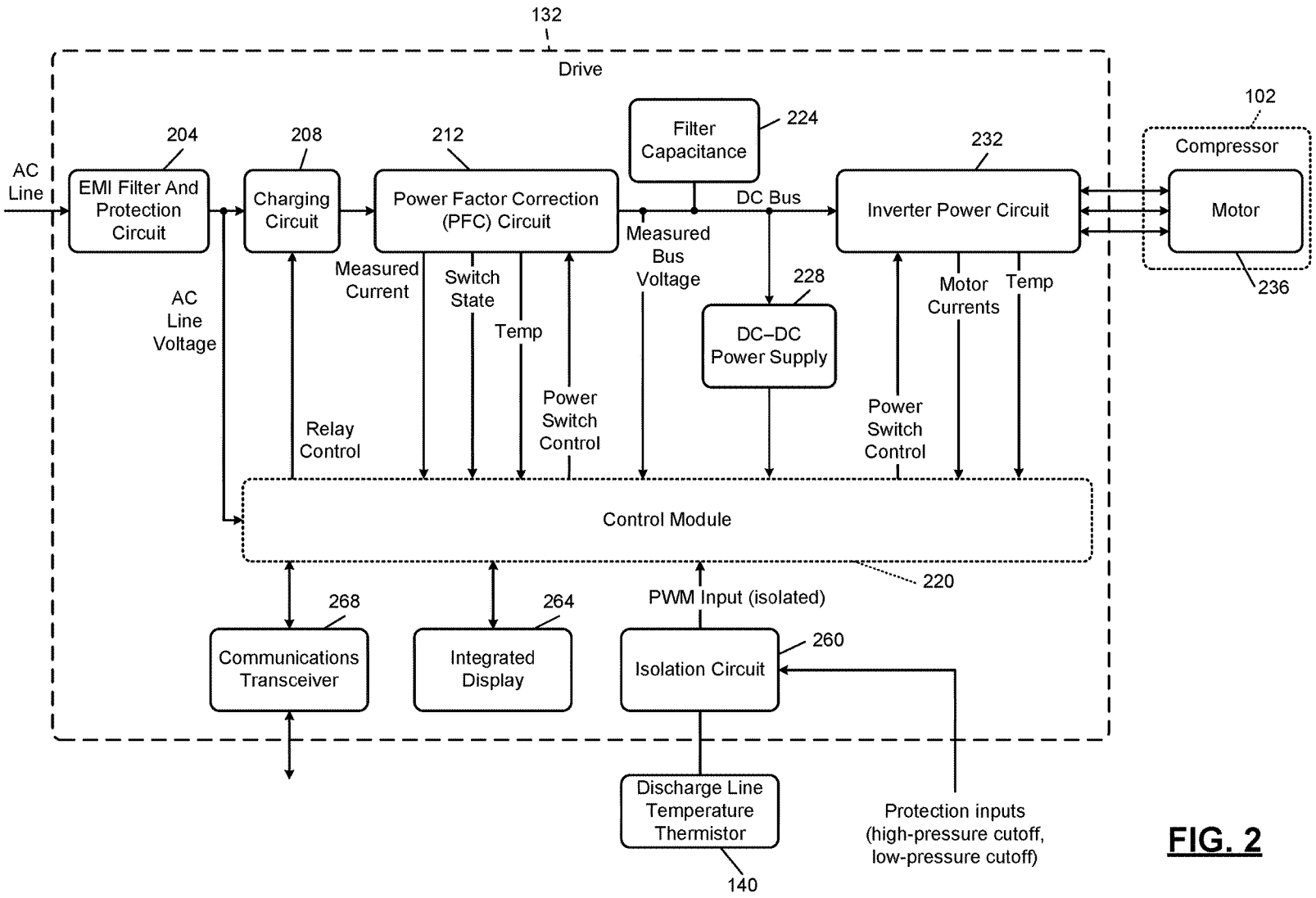
FIG. 2 is a block diagram of an example implementation of the compressor motor drive of FIG. 1.

In FIG. 2, an example implementation of the drive 132 includes an electromagnetic interference (EMI) filter and protection circuit 204, which receives power from an AC line. The EMI filter and protection circuit 204 reduces EMI that might otherwise be injected back onto the AC line from the drive 132. The EMI filter and protection circuit 204 may also remove or reduce EMI arriving from the AC line. Further, the EMI filter and protection circuit 204 protects against power surges, such as may be caused by lightening, and/or other types of power surges and sags.

A charging circuit 208 controls power supplied from the EMI filter and protection circuit 204 to a power factor correction (PFC) circuit 212. For example, when the drive 132 initially powers up, the charging circuit 208 may place a resistance in series between the EMI filter and protection circuit 204 and the PFC circuit 212 to reduce the amount of current inrush. These current or power spikes may cause various components to prematurely fail.

After initial charging is completed, the charging circuit 208 may close a relay that bypasses the current-limiting resistor. For example, a control module 220 may provide a relay control signal to the relay within the charging circuit 208. In various implementations, the control module 220 may assert the relay control signal to bypass the current-limiting resistor after a predetermined period of time following start up, or based on closed loop feedback indicating that charging is near completion.

The PFC circuit 212 converts incoming AC power to DC power. The PFC circuit 212 may not be limited to PFC functionality—for example, the PFC circuit 212 may also perform voltage conversion functions, such as acting as a boost circuit and/or a buck circuit. In some implementations, the PFC circuit 212 may be replaced by a non-PFC voltage converter. The DC power may have voltage ripples, which are reduced by filter capacitance 224. Filter capacitance 224 may include one or more capacitors arranged in parallel and connected to the DC bus. The PFC circuit 212 may attempt to draw current from the AC line in a sinusoidal pattern that matches the sinusoidal pattern of the incoming voltage. As the sinusoids align, the power factor approaches one, which represents the greatest efficiency and the least demanding load on the AC line.

The PFC circuit 212 includes one or more switches that are controlled by the control module 220 using one or more signals labeled as power switch control. The control module 220 determines the power switch control signals based on a measured voltage of the DC bus, measured current in the PFC circuit 212, AC line voltages, temperature or temperatures of the PFC circuit 212, and the measured state of a power switch in the PFC circuit 212. While the example of use of measured values is provided, the control module 220 may determine the power switch control signals based on an estimated voltage of the DC bus, estimated current in the PFC circuit 212, estimated AC line voltages, estimated temperature or temperatures of the PFC circuit 212, and/or the estimated or expected state of a power switch in the PFC circuit 212. In various implementations, the AC line voltages are measured or estimated subsequent to the EMI filter and protection circuit 204 but prior to the charging circuit 208.

The control module 220 is powered by a DC-DC power supply 228, which provides a voltage suitable for logic of the control module 220, such as 3.3 Volts, 2.5 Volts, etc. The DC-DC power supply 228 may also provide DC power for operating switches of the PFC circuit 212 and an inverter power circuit 232. For example only, this voltage may be a higher voltage than for digital logic, with 15 Volts being one example.

The inverter power circuit 232 also receives power switch control signals from the control module 220. In response to the power switch control signals, switches within the inverter power circuit 232 cause current to flow in respective windings of a motor 236 of the compressor 102. The control module 220 may receive a measurement or estimate of motor current for each winding of the motor 236 or each leg of the inverter power circuit 232. The control module 220 may also receive a temperature indication from the inverter power circuit 232.

For example only, the temperature received from the inverter power circuit 232 and the temperature received from the PFC circuit 212 are used only for fault purposes. In other words, once the temperature exceeds a predetermined threshold, a fault is declared and the drive 132 is either powered down or operated at a reduced capacity. For example, the drive 132 may be operated at a reduced capacity and if the temperature does not decrease at a predetermined rate, the drive 132 transitions to a shutdown state.

The control module 220 may also receive an indication of the discharge line temperature from the compressor 102 using the thermistor 140. An isolation circuit 260 may provide a pulse-width-modulated representation of the resistance of the thermistor 140 to the control module 220. The isolation circuit 260 may include galvanic isolation so that there is no electrical connection between the thermistor 140 and the control module 220.

The isolation circuit 260 may further receive protection inputs indicating faults, such as a high-pressure cutoff or a low-pressure cutoff, where pressure refers to refrigerant pressure. If any of the protection inputs indicate a fault and, in some implementations, if any of the protection inputs become disconnected from the isolation circuit 260, the isolation circuit 260 ceases sending the PWM temperature signal to the control module 220. Therefore, the control module 220 may infer that a protection input has been received from an absence of the PWM signal. The control module 220 may, in response, shut down the drive 132.

The control module 220 controls an integrated display 264, which may include a grid of LEDs and/or a single LED package, which may be a tri-color LED. The control module 220 can provide status information, such as firmware versions, as well as error information using the integrated display 264. The control module 220 communicates with external devices, such as the system controller 130 in FIG. 1, using a communications transceiver 268. For example only, the communications transceiver 268 may conform to the RS-485 or RS-232 serial bus standards or to the Controller Area Network (CAN) bus standard.

PFC Circuits

Figure 3A:
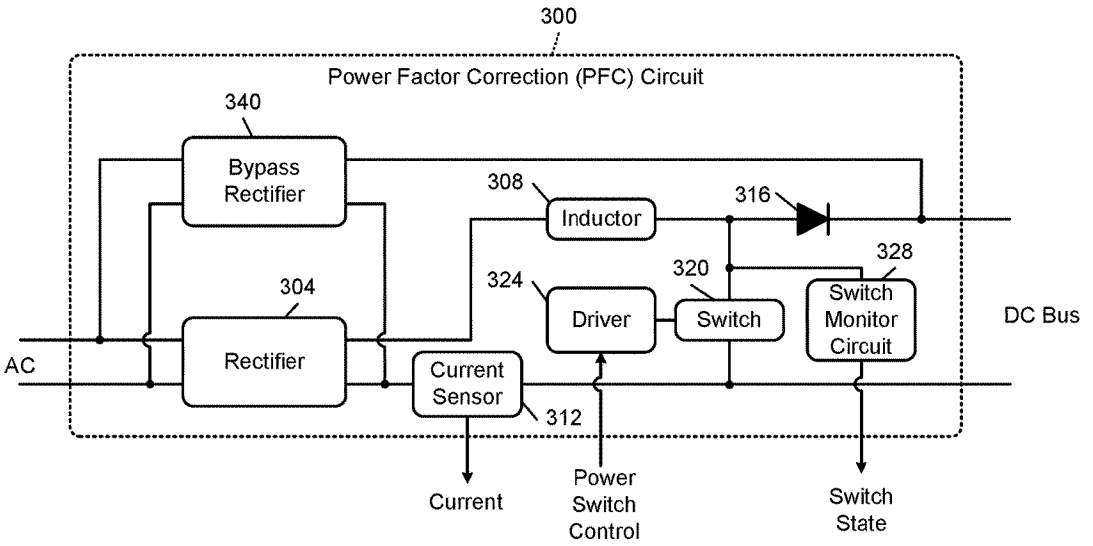
FIG. 3A is a block diagram of an example implementation of the power factor correction (PFC) circuit of FIG. 2.

In FIG. 3A, a PFC circuit 300 is one implementation of the PFC circuit 212 of FIG. 2. The PFC circuit 300 includes a rectifier 304 that converts incoming AC into pulsating DC. In various implementations, the rectifier 304 includes a full-wave diode bridge. The DC output of the rectifier 304 is across first and second terminals. The first terminal is connected to an inductor 308, while the second terminal is connected to a current sensor 312. An opposite end of the inductor 308 is connected to a node that is common to the inductor 308, an anode of a diode 316, and a first terminal of a switch 320.

The PFC circuit 300 generates a DC bus, where a first terminal of the DC bus is connected to a cathode of the diode 316 while a second terminal of the DC bus is connected to the second output terminal of the rectifier 304 via the current sensor 312. The current sensor 312 can, therefore, sense the current within the switch 320 as well as the current in the DC bus and current in the inductor 308. The second terminal of the DC bus is also connected to a second terminal of the switch 320.

A driver 324 receives the power switch control signal from the control module 220 of FIG. 2 and rapidly charges or discharges a control terminal of the switch 320. For example, the switch 320 may be a field effect transistor with a gate terminal as the control terminal. More specifically, the switch 320 may be a power metal-oxide-semiconductor field-effect transistor (MOSFET), such as the STW38N65M5 power MOSFET from STMicroelectronics. The driver 324, in response to the power switch control signal, charges or discharges the capacitance at the gate of the field effect transistor.

A switch monitor circuit 328 measures whether the switch is on or off. This closed loop control enables the control module 220 to determine whether the switch 320 has reacted to a command provided by the power switch control signal and may also be used to determine how long it takes the switch 320 to respond to that control signal. The measured switch state is output from the switch monitor circuit 328 back to the control module 220. The control module 220 may update its control of the power switch control signal to compensate for delays in turning on and/or turning off the switch 320.

In FIG. 3A, the inductor, the switch 320, and the diode 316 are arranged in a boost configuration. In brief, the switch 320 closes, causing current through the inductor 308 to increase. Then the switch 320 is opened, but the current through the inductor 308 cannot change instantaneously because the voltage across an inductor is proportional to the derivative of the current. The voltage across the inductor 308 becomes negative, meaning that the end of the inductor 308 connected to the anode of the diode 316 experiences a voltage increase above the voltage output from the rectifier 304.

Once the voltage at the anode of the diode 316 increases above the turn-on voltage of the diode 316, the current through the inductor 308 can be fed through the diode 316 to the DC bus. The current through the inductor 308 decreases and then the switch 320 is closed once more, causing the current and the inductor 308 to increase.

In various implementations, the switch 320 may be turned on until the current sensor 312 determines that a predetermined threshold of current has been exceeded. At that time, the switch 320 is turned off for a specified period of time. This specified period may be adaptive, changing along with the voltage of the DC bus as well as the voltage of the AC input change. However, the off time (when the switch 320 is open) is a specified value. Once a time equal to the specified value has elapsed, the switch 320 is turned back on again and the process repeats. The off time can be fixed or variable. In the case of the off time being variable, the off time can be limited to at least a predetermined minimum off time.

To reduce the physical size and parts cost of the PFC circuit 300, the inductance of the inductor 308 (which may be the largest contributor to the physical size of the PFC circuit 300) may be lowered. However, with a lower inductance, the inductor 308 will saturate more quickly. Therefore, the switch 320 will have to operate more quickly. While more quickly and smaller are relative terms, present power switching control operates in the range of 10 kilohertz to 20 kilohertz switching frequencies. In the present application, the switching frequency of the switch 320 may be increased to more than 50 kilohertz, more than 100 kilohertz, or more than 200 kilohertz. For example, the switching frequency of the switch may be controlled to be approximately 200 kilohertz.

The switch 320 is therefore chosen to allow for faster switching as well as to have low switching losses. With faster switching, the inductance of the inductor 308 can be smaller. In addition, the diode 316 may need to be faster. Silicon carbide diodes may have fast response times. For example, the diode 316 may be an STPSC2006CW Silicon Carbide dual diode package from STMicroelectronics.

In order to accurately drive the switch 320 when operating at higher speeds, the control strategy must similarly be accelerated. For example only, the control module 220 may include multiple devices, such as a microcontroller configured to perform more involved calculations and an FPGA (field programmable gate array) or PLD (programmable logic device) configured to monitor and respond to inputs in near real time. In this context, near real time means that the time resolution of measurement and time delay in responding to inputs of the FPGA or PLD is negligible compared to the physical time scale of interest. For faster switching speeds, the near real time response of the FPGA/PLD may introduce non-negligible delays. In such cases, the delay of the FPGA/PLD and driving circuitry may be measured and compensated for. For example, if the turn-off of a switch occurs later than needed because of a delay, the turn-off can be instructed earlier to compensate for the delay.

A bypass rectifier 340 is connected in parallel with the rectifier 304 at the AC line input. A second output terminal of the bypass rectifier 340 is connected to the second terminal rectifier 304. However, a first output terminal of the bypass rectifier 340 is connected to the cathode of the diode 316.

As a result, when the PFC circuit 300 is not operating to boost the DC bus voltage, the bypass rectifier 340 will be active when the line-to-line voltage of the AC input exceeds the voltage across the DC bus. The bypass rectifier 340, in these situations, diverts current from passing through the diode 316. Because the inductor 308 is small, and the switch 320 switches rapidly, the diode 316 is also selected to exhibit fast switching times. The diode 316 may, therefore, be less tolerant to high currents, and so current is selectively shunted around the diode 316 by the bypass rectifier 340.

In addition, the current path through the rectifier 304 and the diode 316 experiences three diode voltage drops or two diode voltage drops and the switch voltage drop, while the path through the bypass rectifier 340 experiences only two diode voltage drops. While the single phase AC input in FIG. 3A is associated with a boost converter topology, the present disclosure also encompasses a buck converter topology or a buck-boost converter topology.

Figure 3B:
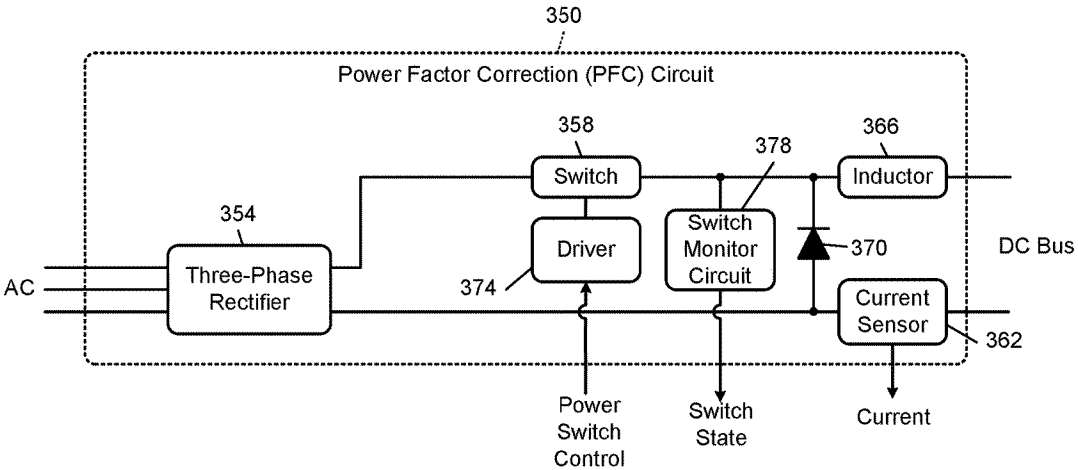
FIG. 3B is a block diagram of another example implementation of the PFC circuit of FIG. 2.

In FIG. 3B, a buck converter topology is shown with a three-phase AC input signal. Note that the principles of the present disclosure also apply to a boost converter or buck-boost converter topology used with a three-phase AC input. A PFC circuit 350 represents another implementation of the PFC circuit 212 of FIG. 2.

A three-phase rectifier 354 receives three-phase AC and generates pulsating DC across first and second terminals. A switch 358 is connected between the first terminal of the three-phase rectifier 354 and a common node. The common node is connected to an inductor 366 and a cathode of a power diode 370.

An anode of the power diode 370 is connected to a second terminal of the three-phase rectifier 354. An opposite terminal of the inductor 366 establishes one terminal of the DC bus, while the second output of the three-phase rectifier 354 establishes the other terminal of the DC bus. In the configuration shown in FIG. 3B, the switch 358, the inductor 366, and the diode 370 are configured in a buck topology.

A current sensor 362 is connected in series between the anode of the diode 370 and the DC bus. In other implementations, the current sensor 362 may be located in series with the inductor 366. In other implementations, the current sensor 362 may be located in series with the switch 358. In other implementations, the current sensor 362 may be located in series between the anode of the diode 370 and the second output of the three-phase rectifier 354. The current sensor 362 measures current through the inductor 366 as well as current through the DC bus and provides a current signal indicative of the amount of the current.

A driver 374 drives a control terminal of the switch 358 based on a power switch control signal from the control module 220 in FIG. 2. A switch monitor circuit 378 detects whether the switch 358 has opened or closed and reports the switch state to the control module 220. With the location of the current sensor 362, the current sensor 362 will measure approximately zero current when the switch 358 is open.

Figure 4:
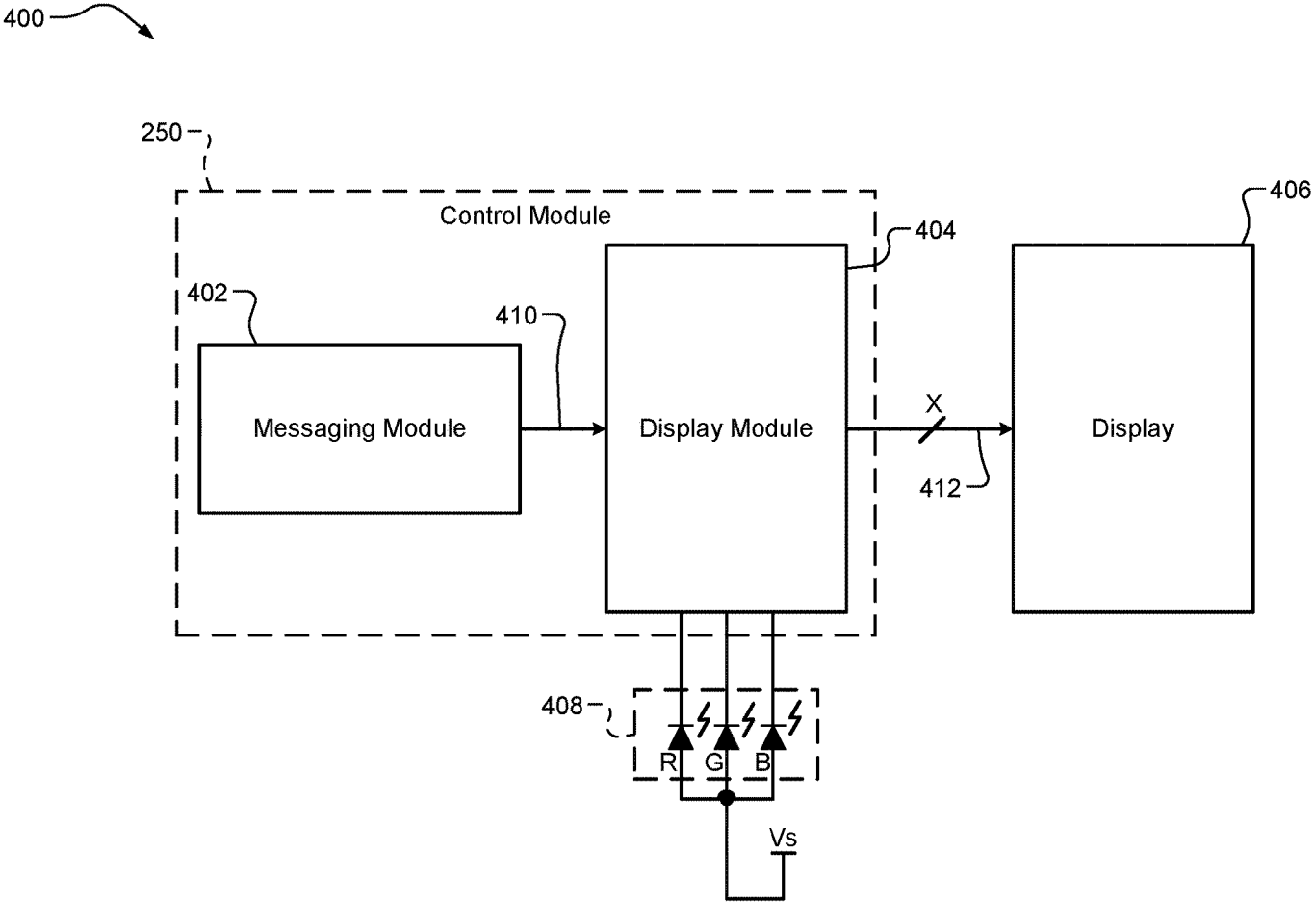
FIG. 4 is schematic and block diagram of an indication system in accordance with an embodiment of the present disclosure.

FIG. 4 shows an indication system 400 including a messaging module 402, a display module 404, a display 406 and one or more light emitting diodes (LEDs). Although shown separately, the display module 404 may be implemented as part of the messaging module 402 and/or the display 406 may be driven directly from the messaging module 402. A single tri-color LED 408 is shown having three diodes (identified as R, G, B for corresponding red, green, blue light emitted therefrom). The messaging module 402 may include and/or be implemented as a microprocessor. The messaging module 402 and/or the display module 404 may be implemented in the control module 220 of FIG.

2. The control module 220, the messaging module 402, and/or the display module 404 may be implemented as one or more field programmable gate arrays (FPGAs).

The messaging module 402 generates messages for display on the display 406. The messages may be transferred to the display module 404 via an interface 410. The interface 410 may include: a serial peripheral interface (SPI) bus; a parallel bus; wireless (e.g., Bluetooth®) transceivers; a multi-master, multi-slave, single-ended, serial computer bus (e.g., $I^2C$® bus) and/or other communication interface. The interface 410 may include a predetermined number of signal lines X. As an example, the interface 410 may include 4 signal lines. The 4 signal lines may include: a serial clock (SCLK) signal line; a master output/slave input (MOSI) signal line; a master input/slave output (MISO) signal line; and a slave select $\overline{SS}$ signal line. The messages for the display 406 may be sent, for example, via the MOSI signal line of the interface 410. As an example, the messages may include 16-bit packets, where each of the packets includes: a read/write bit; 3 control bits, and 12 data bits (one for each row and column of the display 406). The read/write bit may be set low when reading data from the display module 404. The 3 control bits may be set based on different tasks being performed. The messaging module 402, via the 3 control bits, may: instruct the display module 404 to display a certain message on the display 406; instruct the display module 404 to generate an indication signal via the LED 408; to cycle to a next column of the display 406; that an error exists in sending data to the display module 404; etc. The read/write bit may be set high when displaying a message. The messages may also include cyclical redundancy check (CRC) data for error correction of data transferred to the display module 404.

The messaging module 402 may also generate indication signals and/or illumination patterns for the LED 408. The illumination patterns may include color patterns, illumination periods, blinking patterns (e.g., frequency patterns and/or duty cycle patterns), etc. for providing different indications via the LED 408. If more than one LED is included, illumination patterns for each of the LEDs may be generated. The illumination patterns may also be provided from the messaging module 402 to the display module 404 via one or more signal lines of the interface 410.

The display module 404 may include and/or be implemented as a FPGA. In one embodiment, the display module 404 is implemented as a FPGA having a predetermined low gate count (e.g., 240-2210 logic elements) and/or is capable of handling a low predetermined number of bytes of data (e.g., 240 bytes of data). In one embodiment, the display module 404 has 570 logic elements. The display module 404 generates signals to display data on the display 406. These signals are provided to the display 406 via a display (or second) interface 412. The display interface 412 may include, for example 12 signal lines, as further described below with respect to FIG. 5. In one embodiment, the FPGA of the display module 404 is unable to handle storing 35 bits (one bit for each LED of a 5-by-7 array of LEDs of the display 406) and scanning the array of LEDs to display corresponding glyphs. For this reason, the messaging module 402 generates column data, which is forwarded to the display module 404, such that the display module 404 can then simply generate output signals based on the column data. The display 406 may have any number of rows and columns of LEDs. The display module 404 may display characters on any number of the LEDs. The messaging module 402 and the display module 404 may operate in multiple modes, where a first mode includes displaying characters that use a majority to all of the LEDs, and where a second mode includes using only a portion (or sub-set) of the LEDs of the display 406 and displaying only one or more types of character (e.g., displaying only numbers). While in the second mode, certain ones of the LEDs of the display 406 may not be used.

The display module 404 may also: receive messages from the messaging module 402 for the LED 408; and/or generate indication signals for the LED 408. In one embodiment, the display module 404 generates indication signals for the LED 408 without and/or independent of receiving a signal for the LED 408 from the messaging module 402.

The illumination pattern on the LED 408 may correspond to the type of message being displayed on the display 406. A user or technician may compare the indication signal generated on the LED 408 to a message displayed on the display 406 to determine whether the indication signal is consistent with the message displayed. As an example, if the indication signal of the LED 408 indicates that the message data has been received for the display 406 and the display 406 is displaying a message, then the indication signal is consistent with the message being displayed. An inconsistency may exist, for example, when: the indication signal of the LED 408 indicates an error or fault exists and the display 406 displays a message corresponding to no error or fault; or the indication signal indicates that no error or fault exists and the display 406 is displaying an error or fault.

The LED 408 may be used to indicate that: a fault exists in receiving message data for the display from the messaging module 402; a fault exists in operation of the display 406 and/or a LED 408 of the display 406; an error exists in messaging data received for the display 406; and/or a fault exists in controlling lines of the display 406. The display 406 may be used to indicate that: a fault exists in receiving an indication signal from the messaging module 402 for the LED 408; a fault exists in operation of the LED 408; and/or a fault exists in sending an indication signal to the LED 408.

The control module 250, the messaging module 402 and/or the display module 404 may monitor and/or receive various parameters. The various parameters may be associated with the compressor 102 and/or the drive 132 of FIG. 2. The parameters may include: AC input and/or output voltages; DC voltages; bus voltages; voltage and/or current supplied to the compressor 102; current supplied to, passing through, and/or output from a module, circuit, device or component of the drive 132; temperatures; and/or other detected and/or monitored parameters. The messaging module 402 and/or the display module 404 may generate the disclosed messages and indication signals based on the parameters.

The messages displayed on the display 406 may include status messages, error and/or fault messages, diagnostic information, software version messages, and/or other messages associated with: operation of the drive 132; modules, devices and/or components of the drive 132; and/or operation of the compressor 102. The status messages may indicate: statuses of the drive 132; statuses of the modules, devices and/or components of the drive 132; and/or status of the compressor 102. This may include indicating whether one or more of the compressor 102, the drive 132, a module of the drive 132, a device of the drive 132, and a component of the drive 132 are in an ON state or an OFF state. The status messages may indicate voltages, current levels and/or amounts of power provided to, drawn by and/or output from one or more of the compressor 102, the drive 132, a module of the drive 132, a device of the drive 132, and a component of the drive 132. The diagnostic messages may indicate parameter values generated based on a diagnostic test initiated and/or performed by the control module 250. A diagnostic test may be manually initiated by a technician or automatically initiated by the control module 250 and/or messaging module 402. If manually initiated, the control module 250 and/or messaging module 402 may receive an input signal requesting that the diagnostic test be performed. The control module 250 and/or the messaging module 402 may generate one or more resultant diagnostic messages and/or indication signals and indicate the diagnostic messages and indication signals on the display 406 and LED 408.

The indication signals generated using the LED 408 may include: providing a blinking green light at a predetermined frequency if no error and/or fault exists; providing a red light when an error and/or fault exists with the drive 132, the control module 250, the messaging module 402, the display module 404, and/or other module, device and/or component; and providing a blinking red light, blinking blue light, and/or other blinking colored light to indicate a type of an error, a type of a fault, or a diagnostic code. The control module 250, the messaging module 402, and/or the display module 404 may control the number of blinks within a predetermined period; the color of the blinking light; the pattern of different colors illuminated; the frequency of the blinking; and/or other provided illumination patterns corresponding to the error, the type of a fault, and the diagnostic code being indicated. The diagnostic code may correspond to a diagnostic message displayed on the display 406. If the LED 408 provides a green light or is OFF for an extended period of time, this may indicate that the messaging module 402 is in a locked state and/or is experiencing an electrical and/or code problem. The predetermined illumination pattern may be provided to indicate that no data, glyphs, and/or message have been received from the messaging module 402 and/or that the data, glyphs, and/or message are invalid. A glyph refers to a character or symbol in a predetermined set of characters or symbols that may be displayed on the display 406 as part of a message. The predetermined set of characters or symbols may include certain American standard code for information interchange (ASCII) characters.

The diodes of the LED 408 may be connected in parallel via respective signals lines connected to the display module 404. Anodes of the diodes may be connected to a power source providing a supply voltage Vs. Cathodes of the diodes are connected to respective terminals of the display module 404. Light emitted from the diodes is combined to provide a single illumination source. As a result, the LED 408 may emit different colors and/or color patterns to provide different indication signals.

Figure 5:
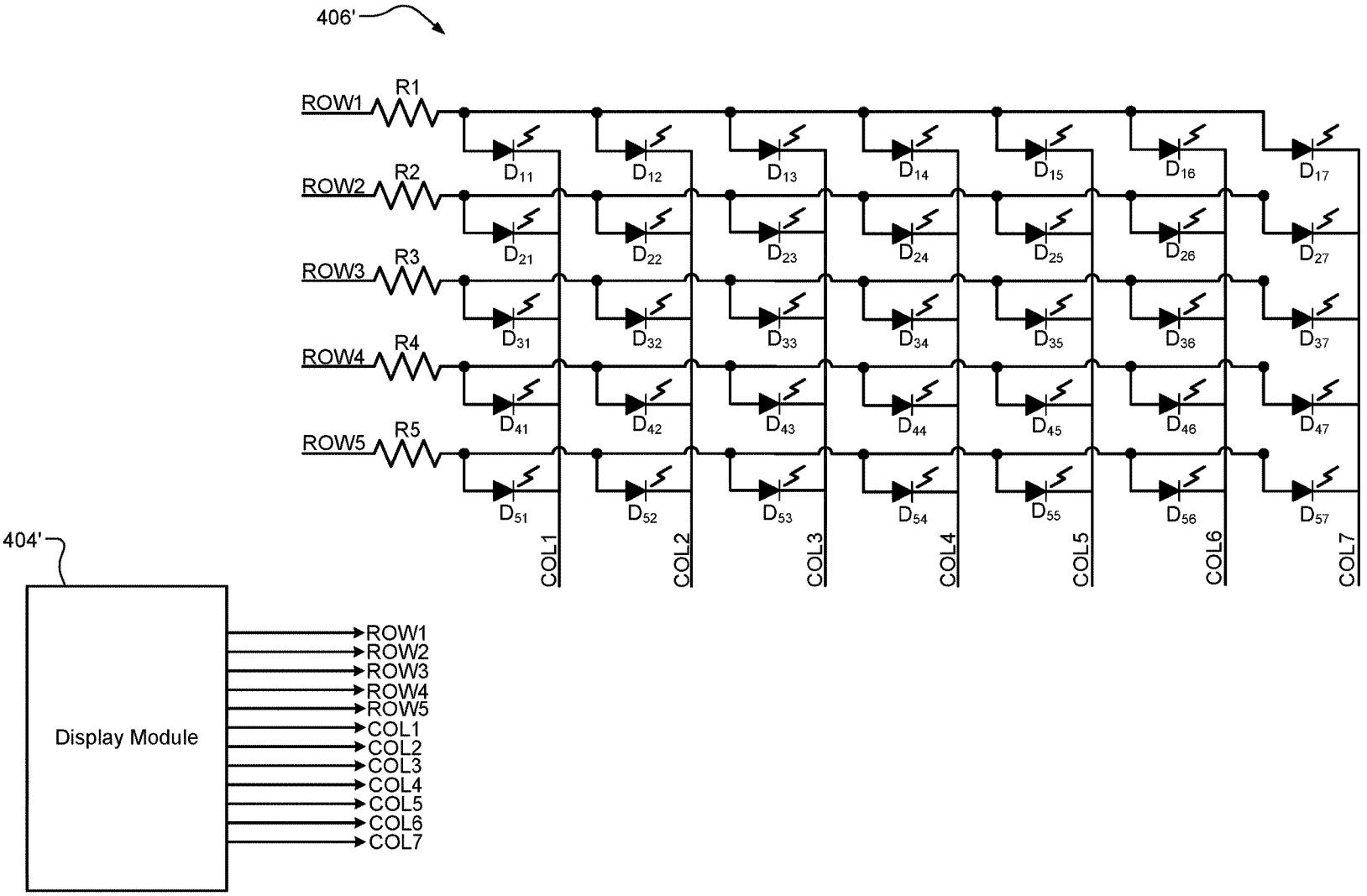
FIG. 5 is a schematic and block diagram of a display module and a display in accordance with an embodiment of the present disclosure.

FIG. 5 shows an example of the display module 404 and an example of the display 406 of FIG. 4. As shown, display module 404' includes 12 output ports; one output port for each row or column of the display 406'. The output ports may be directly connected to row and column control lines ROW1-5 and COL1-7 of the display 406'. In the example shown, the display 406' includes 5 rows and 7 columns of LEDs. Although a certain number of rows and columns are shown, the display 406' may include a different number of rows and columns. The number of rows and columns shown in FIG. 5 is appropriate for a display module that is implemented as a FPGA, for example, having 240, 570, or suitable number of logic elements.

The display 406' includes resistances R1-R5 for each input of the rows and an array of LEDs. In the example shown, the display 406' includes 35 LEDs, 7 LEDs per row and 5 LEDs per column. Anodes of the LEDs in each of the rows are connected to an output of the corresponding one of the resistances for that row. Cathodes of the LEDs in each of the columns are connected to a corresponding one of the output ports for that column of the display module 404'.

The display 406' includes the array of LEDs and does not include a transistor. Signals are provided to the appropriate LEDs column-by-column for predetermined periods of time and then current through the LEDs is permitted to decay over time. A state of a LED in the display 406' is not maintained, unlike a state of a cell in a traditional display having an array of cells, where each of the cells has a corresponding transistor. In a traditional display, having an array of cells with respective transistors, the state of the transistors is maintained until changed by a processor. Operation of the display 406' allows for the LEDs to be illuminated using less power than that associated with a traditional display and fewer corresponding signal lines. For example, for an array having 7 columns and 5 rows there are 12 signals lines for 35 LEDs, instead of a single line for each LED.

The display module 404' may display portions of glyphs on the display 406' in a column-by-column fashion and a reverse column fashion from right to left. For example, the right most (or last) column receives a first left most portion of a glyph prior to the other columns receiving the same first portion. The first portion is shifted to the left and a next portion of the glyph is provided to the last column. For each glyph of the message being displayed, this process is continued until the last portion of the last glyph of the message is displayed in the first column of the display 406'. Messages may be iteratively displayed.

The display module 404' may cycle through the columns at a predetermined refresh rate. For example, the display module 404' may cycle through the columns at 1,000 columns per second (referred to as a 1,000 kilo-hertz (kHz) scan). Put another way, each of the columns may be cycled approximately 143 times per second. The refreshing of the display may not change which LEDs are currently emitting light. This may include providing new portions of glyphs to appropriate columns of the display 406' and/or refreshing previously displayed portions. Power is saved by refreshing the display column-by-column rather than all columns at the same time, such that power is provided to each LED that is emitting light 1/7th of a period of time associated with illuminating that LED, as opposed to 7/7ths of the period of time. Also, to increase brightness of the LEDs and not consume additional power, each of the LEDs that are illuminated may be provided a predetermined amount of current (e.g., 7 milli-amperes (mA)) for 1/7th of a period of time, as opposed to 1 mA for the whole period of time.

A rate at which glyphs move across the display 406' is slower than the refresh rate. As an example, glyphs may be moved across the display 406' at a rate of 8-10 columns per second. Thus, each portion of a character displayed may be moved from one column to the next every approximately 1/10 of second.

The display module 404' may display a predetermined number of glyphs and/or portions of glyphs on the display 406' at any moment in time. Each portion of the glyphs refers to a portion that is to be displayed via one of the columns of the display 406'. In the example shown, the display module 404' may display: 2 glyphs (each glyph being associated with 5-by-3 LEDs of the array with a blank (or dark non-illuminated) column between the two glyphs: or simply 2 glyphs (each glyph being associated with 5-by-3 or 5-by-4 LEDs of the array with no blank (dark non-illuminated) column between the two glyphs. At any moment in time, 2 glyphs or portions of 3 glyphs may be shown.

Figure 6:
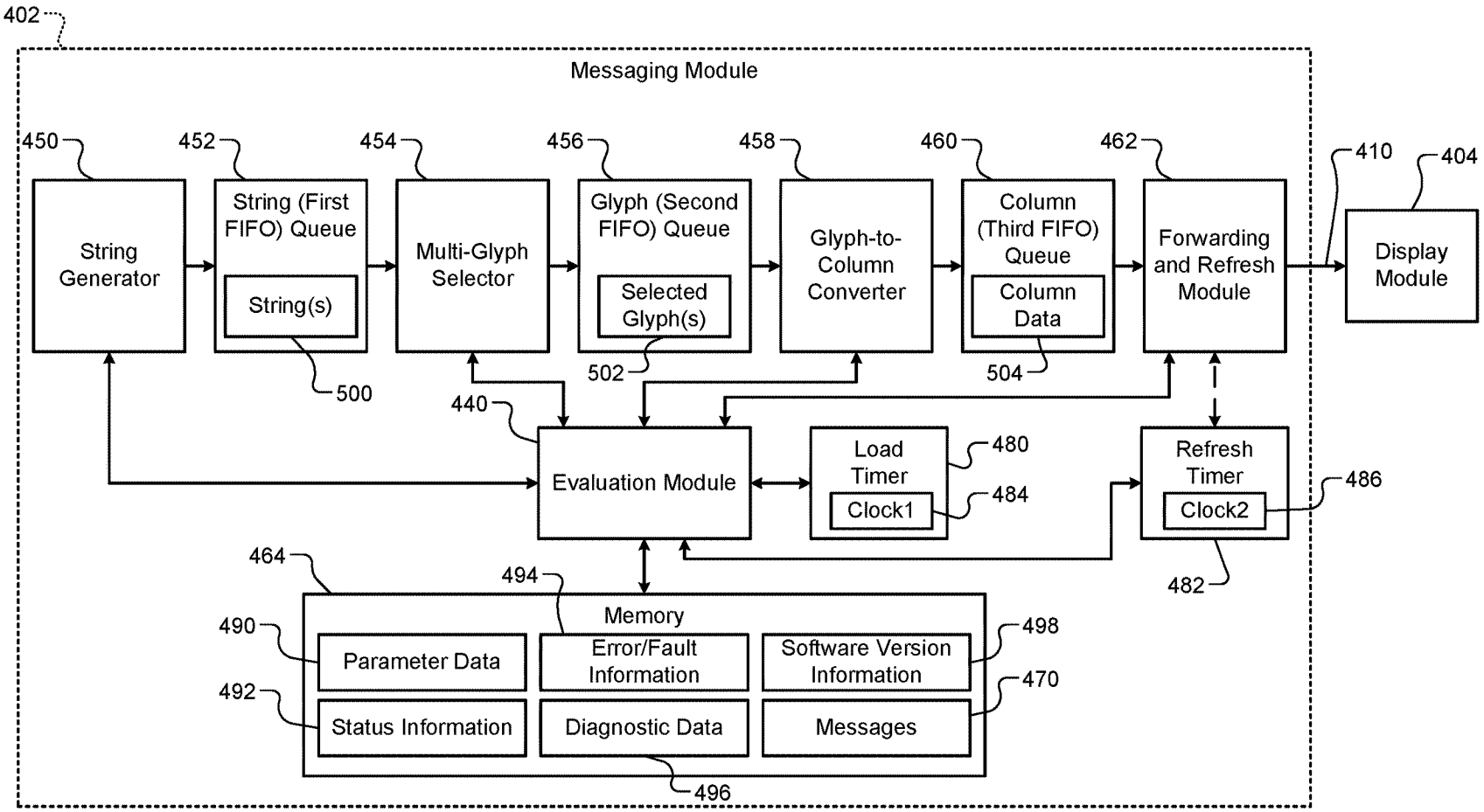
FIG. 6 is a block diagram of a messaging module and the display module in accordance with an embodiment of the present disclosure.

FIG. 6 shows the messaging module 402 and the display module 404 of FIG. 4. The messaging module 402 includes an evaluation module 440, a string generator 450, a string queue 452, a multi-glyph selector 454, a multi-glyph queue 456, a glyph-to-column converter 458, a column queue 460, a forwarding and refresh module 462, and a memory 464. The evaluation module 440 monitors the above-stated parameters associated with the compressor 102 of FIG. 1, the drive 132 of FIG. 2, and the modules, devices and components of the drive 132 (some of which are shown in FIG. 3). The evaluation module 440 may also perform the stated diagnostic tests and/or receive data associated with the stated diagnostic tests. The evaluation module may generate the messages and/or indication signals disclosed herein for the display 406 and/or the LED 408 based on the parameters and/or the diagnostic data. The messages and/or indication signals may be stored in the memory 464. As an alternative, the evaluation module 440 may access the memory 464 to select one of pre-stored messages appropriate for a current indication event. Messages 470 are shown in FIG. 6 to represent the stated messages and indication signals.

The evaluation module 440 may control operation and/or timing of the modules 450, 454, 458, and 462. The timing may be based on clocks of one or more timers. The timers may be implemented as timing modules. In the example shown, a load (or first) timer 480 and a refresh (or second) timer 482 are shown having respective clocks 484, 486. The load timer 480 controls a first rate at which portions of glyphs are transferred from column-to-column of the display 406. The first clock 484 may be, for example, a 8-10 Hz clock. The refresh timer 482 controls a second rate at which the columns of the display 406 are refreshed and/or updated. The second clock 486 may be, for example, a 1 kHz clock. Although the refresh timer 482 and the second clock 486 are shown as part of the messaging module 402, the refresh timer 482 and the second clock 486 may be included in the display module 404 and the display module 404 may refresh states of the LEDs of the display 406 based on the output of the refresh timer 482. In one embodiment, the display module 404 does not include a timer.

The evaluation module 440 may store parameter data 490, status information 492, error/fault information 494, diagnostic data 496, software version information 498 in the memory 464. This information and data may be accessed and/or periodically updated by the evaluation module 440.

The string generator 450 may be implemented as a module and generates one or more strings 500 of glyphs (referred to as glyph strings) based on messages received from the evaluation module 440. The glyph strings 500 are stored in the string queue 452. The string queue 452 may be a first-in-first-out (FIFO) queue, where the first glyph provided to the string queue 452 is the first glyph to leave the string queue 452. The string queue 452 may insert blank glyphs between successive glyphs, which are associated with blank column spaces that are to occur between successively displayed glyphs.

The multi-glyph selector 454 may be implemented as a module and may select a predetermined number of glyphs 502 from the string queue 452. In one embodiment, the multi-glyph selector 454 selects a next three glyphs. Portions of up to three glyphs may be displayed on the display 406 (if implemented as shown in FIG. 5). In another embodiment, the multi-glyph selector 454 selects a next two glyphs. In another embodiment, the multi-glyph selector 454 selects one glyph at a time. The selected glyphs 502 may be stored in the multi-glyph queue 456. The multi-glyph queue 456 may be a second FIFO queue. The multi-glyph selector 454 may receive, transfer, and/or output a glyph every predetermined period (e.g., 0.4 seconds).

The glyph-to-column converter 458 may be implemented as a module and convert the selected glyphs into column data 504. The glyph-to-column converter 458 may generate an index value to access a 2 byte packet, where the 2 byte packet includes 16 bits; 15 bits associated with a 5-by-3 glyph and a dummy bit. As an example, if numbers 0-9, signs :, ;, <, =, >, ?, @, and letters A-Z are used in generating the messages, which are associated with ASCII decimal values 48-90, the messaging module 402 may subtract 48 from the corresponding ASCII decimal value to provide a reduced index value. The index value may be provided to the display module 404', rather than the ASCII decimal value. For example, the index value for the number '0' may be 0 rather than 48. If only the letters A-Z are used or are the first entries in as stored table, then the messaging module 402 may subtract 65 from the corresponding ASCII decimal value, such that the index value for the letter 'A' is 0, not 65. The index values may be stored along with corresponding 16 bit packets for the glyphs as an array or table in the memory 464. The column data 504 may be stored in the column queue 460. The column queue 460 may be a third FIFO queue.

Although the string generator 450, the multi-glyph selector 454, and the glyph-to-column converter 458 are shown as separate items, two or more of these items may be combined. For example, the multi-glyph selector 454 may receive a message from the evaluation module 440, generate a string, and select a predetermined number of glyphs to store in the multi-glyph queue 456. As another example, the glyph-to-column converter 458 may receive a string from the string generator 450 and select a predetermined number of glyphs to convert to column data and store the column data in the column queue 460. Similarly, although the string queue 452, the multi-glyph queue 456, and the column queue 460 are shown as separate queues, two or more of these queues may be combined as a single queue.

The forwarding and refresh module 462 may generate column signals based on the column data to send to the display module 404 via the interface 410. The display module 404 may then convert the column signals into output signals to be provided to the output ports corresponding to the rows and columns of the display 406. LEDs of the display 406 are illuminated based on the output signals.

For further defined structure of the modules of FIGS. 2-4 and 6 see below provided method of FIGS. 7-8 and below provided definition for the term "module".

Figure 7:
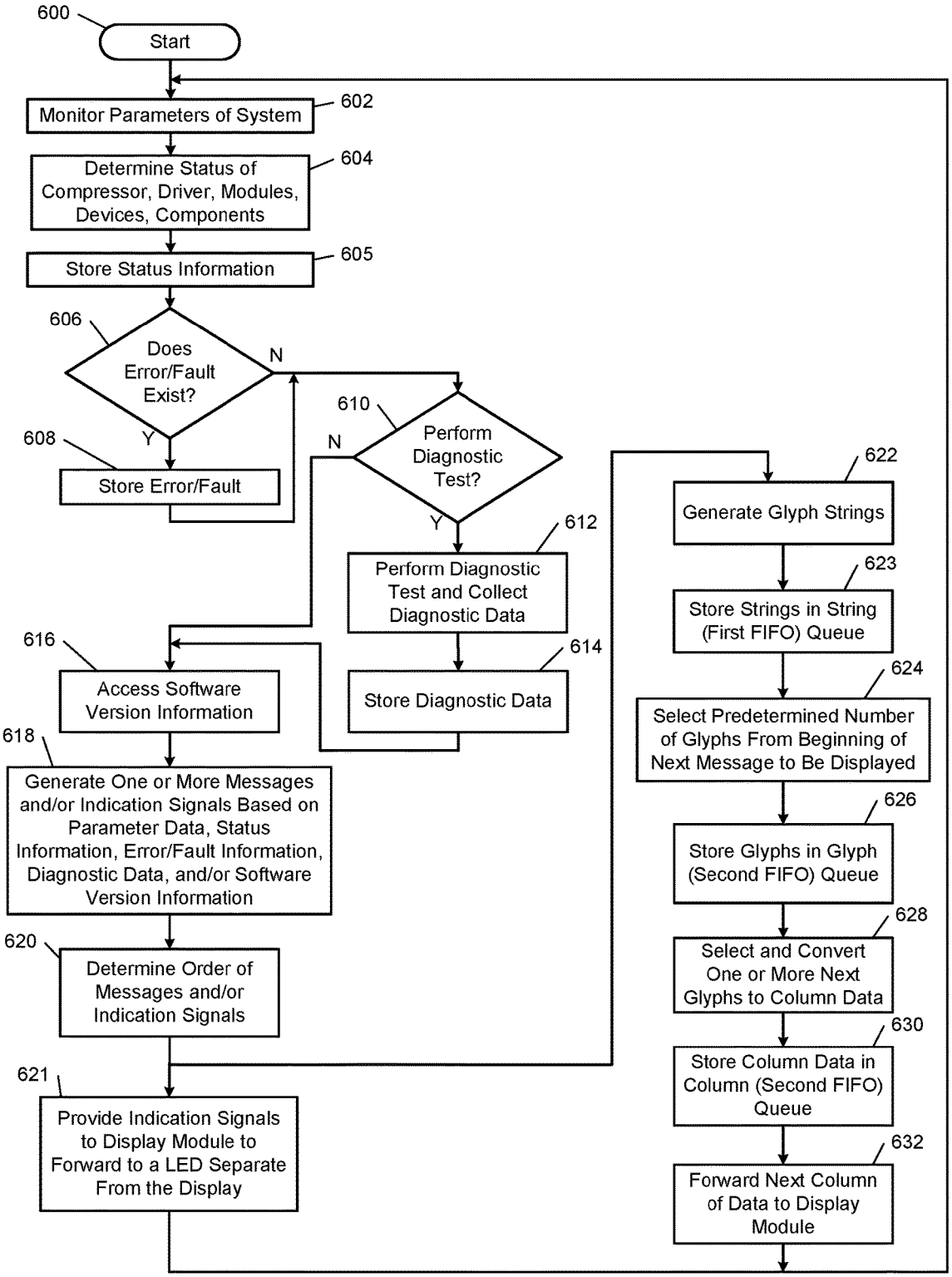
FIG. 7 is a flow diagram illustrating an example method of operating a messaging module of an indication system in accordance with an embodiment of the present disclosure.
Figure 8:
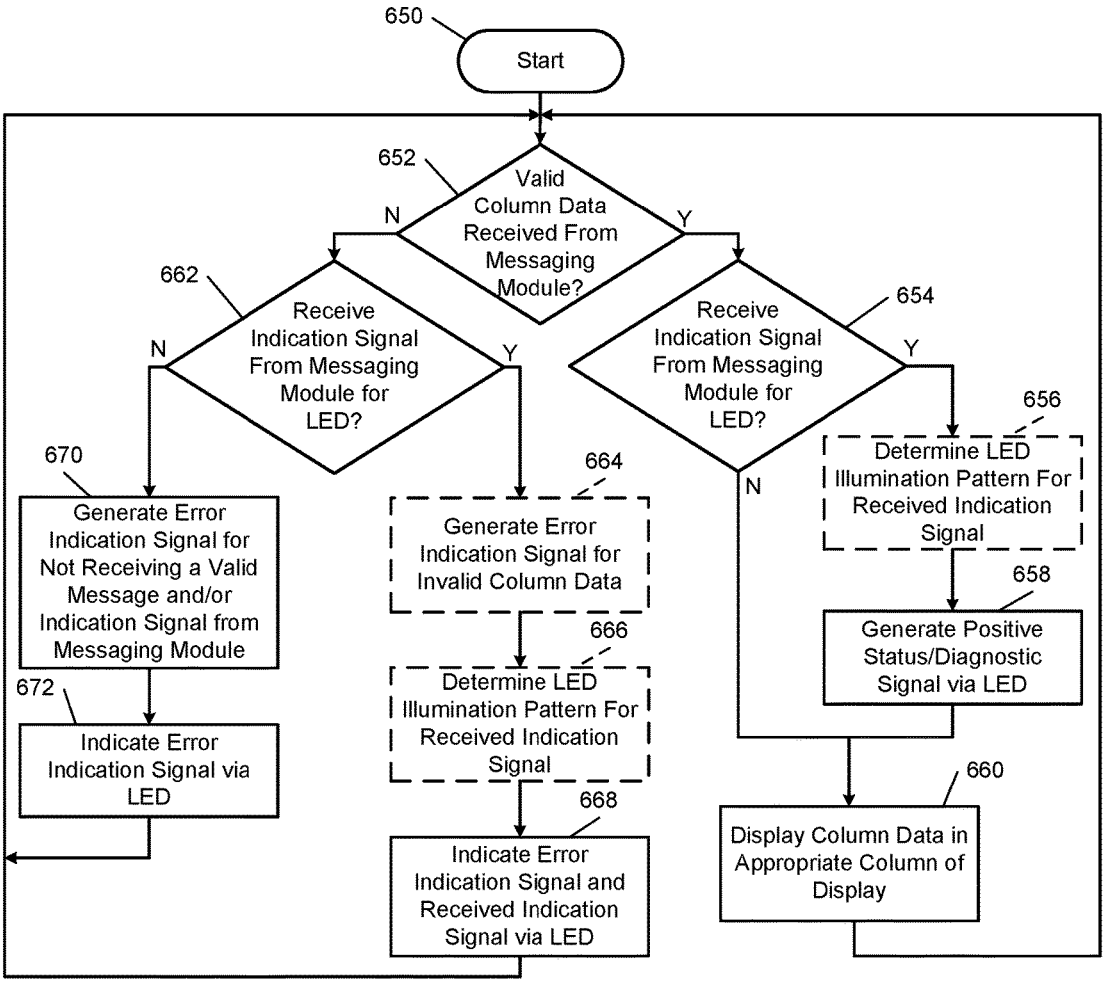
FIG. 8 is a flow diagram illustrating an example method of operating a display module of an indication system.

The systems disclosed herein may be operated using numerous methods, example methods are illustrated in FIGS. 7-8. In FIG. 7, a method of operating a messaging module (e.g., the messaging module 402 of FIG. 4) of an indication system (e.g., the indication system 400 of FIG. 4) is shown. Although the following tasks are primarily described with respect to the implementations of FIGS. 4-6, the tasks may be easily modified to apply to other implementations of the present disclosure. The tasks may be iteratively performed.

The method may begin at 600. At 602, the evaluation module 440 monitors parameters as described above. At 604, the evaluation module 440 may determine the status of the compressor 102, the drive 132, and/or one or more of the modules, devices, and/or components of the drive 132, as described above. The evaluation module 440 may generate status information, status messages and/or status indication signals, which may be stored in the memory 464 at 605.

At 606, the evaluation module 440 may determine whether an error and/or fault exists and generate error and/or fault information and corresponding messages and/or indication signals, which may be stored in the memory 464 at 608. The error and/or fault information, messages and indication signals may indicate that a voltage and/or a current level at an input, within and/or at an output of the compressor 102, the drive 132, and/or one or more of the modules, devices, and/or components of the drive 132 has exceeded one or more predetermined thresholds for predetermined periods. The predetermined thresholds and predetermined periods may be stored in the memory 464. The error and/or fault information and corresponding messages may indicate that a detected temperature of the compressor and/or the drive 132 has exceeded a predetermined temperature. The predetermined temperature may also be stored in the memory 464. Task 610 may be performed subsequent to task 608.

At 610, the evaluation module 440 determines whether to perform a diagnostic test. A diagnostic test may be performed periodically, at predetermined times, and/or based on a user input. If a diagnostic test is to be performed, task 612 is performed, otherwise task 616 may be performed.

At 612, the evaluation module 440 performs a diagnostic test on the compressor 102, the drive 132, and/or one or more of the modules, devices, and/or components of the drive 132. The diagnostic test may include providing an input signal, voltage and/or current level to one or more of the compressor 102, the drive 132, and/or one or more of the modules, devices, and/or components of the drive 132. The diagnostic test may further include monitoring voltages and/or current levels at inputs, within and/or at outputs of the compressor 102, the drive 132, and/or one or more of the modules, devices, and/or components of the drive 132. The collected voltage and current level data may be stored and evaluated based on predetermined and stored values to determine whether: an error and/or fault exists; and/or maintenance ought to be performed on the compressor 102 and/or the drive 132. At 614, the evaluation module 440 stores results of the diagnostic test in the memory 464. The result of task 612 may indicate and/or be evaluated to determine that an error and/or fault exists, which may also be stored in the memory 464.

At 616, the evaluation module 440 may access the software version information 498. The software version information may indicate versions of software executed by the control module 250, the evaluation module 440 and/or by one or more other modules of the drive 132.

At 618, the evaluation module 440 generates one or more messages and/or indication signals. The messages may be for the display 406 and the indication signals may be for the LED 408. The messages and indication signals may be generated based on the parameter data, status information, error and/or fault information, diagnostic data, software version information and/or other data, messages, and/or signals stored in the memory 464. The messages and illumination patterns associated with the indication signals may be stored in the memory 464 and selected, via for example one or more tables, equations, maps, and/or algorithms stored in the memory 464. For example, a table stored in the memory 464 may relate the messages and illumination patterns or indexes of the messages and the illumination patterns to the parameter data, status information, error and/or fault information, diagnostic data, software version information and/or other data, messages, and/or signals stored in the memory 464.

At 620, the evaluation module 440 and/or the string generator 450 may determine an order of messages and/or indication signals to be displayed and/or indicated via the display 406 and the LED 408. The evaluation module 440 and/or the string generator 450 may also determine the frequency of each of the messages and indication signals. A first message and/or indication signal may be displayed at a different frequency and/or for a different duration of time than a second message and/or indication signal. An indication signal corresponding to a message may be indicated during a same period that the message is displayed. The order, frequency and timing of the messages and/or indication signals may be based on priority levels of the messages and/or indication signals. The priority levels (or values) of the messages and/or indication signals may be stored in a table of the memory 464. High priority messages and/or indication signals may be indicated for longer periods of time and/or more often than low priority messages and/or indication signals.

At 621, the indications signals are forwarded to display module 404 to be indicated via the LED 408 based on the order, frequency, duration and timing determined. This may account for any delay associated with performing tasks 622-632. Task 620 may be performed while tasks 621-632 are performed.

At 622, the string generator 450 generates strings of glyphs for the generated or selected messages based on the order, frequency, duration and timing determined. At 623, the strings of glyphs may be stored in the string queue 452.

At 624, the multi-glyph selector 454 selects a next predetermined number of glyphs 502 from the string queue 452. The selected glyphs 502 may be for a string currently being displayed and/or a string to be displayed. As an example, the predetermined number of glyphs 502 may correspond to the number of glyphs (e.g., 2 or 3) being displayed at any moment in time on the display 406. At 626, the multi-glyph selector 454 may store the selected glyphs 502 in the multi-glyph queue 456.

At 628, the glyph-to-column converter 458 selects and converts one or more next glyphs to column data. As an example, a glyph may be divided into segmented data for multiple columns of the display 406. A single glyph may be shown, for example, across 3 or 4 columns of LEDs of the display 406. Each segment of data may correspond to illuminating one or more LEDs in a single corresponding column of the display 406. Each segment of data may include states for the column (and/or row) control lines (or row and column output signals of the display module 404) of the display 406 to illuminate the one or more LEDs in the corresponding column of the display 406. Column data corresponds to signal and/or value for each row. At 630, the column data 504 may be stored in the column queue 460.

At 632, the forwarding and refresh module 462 forwards and/or converts the next column data to packets, which are forwarded to the display module 404 via the interface 410. The display module 404 may then generate output signals to control states of the row and column control lines of the display 406. Column data may be provided to the display 406 in a column-by-column format, such that only one or more LEDs of a single column of the display 406 is provided power at any moment in time. Only one or more LEDs of a single column of the display 406 is provided power at any moment in time. In alternative embodiment, row data may be provided to the display 406 in a row-by-row format, such that only one or more LEDs of a single row of the display 406 is provided power at any moment in time. The data may be refreshed column-by-column or row-by-row.

The current provided to the LEDs are permitted to decay over time and the forwarding and refresh module 462 repetitively cycles through the columns (or rows) of the display 406. Since a person's eye retains the image for a period of time, LEDs in multiple columns may appear to be illuminated at the same time. When LEDs in multiple columns of the display 406 are illuminated at a same time, a refresh pattern of the LEDs may not be noticeable to an eye of a user due to the refresh rate (e.g., 1 kHz). The column data may be provided to the display 406 column-by-column at the predetermined load rate (e.g., 8-10 Hz). The method may end subsequent to performing task 632 or may return to task 602 as shown. The method of FIG. 8 may be performed during task 632.

As can be seen from the above-stated tasks, the messaging module 402 performs a large percentage of the tasks in displaying a message. By having a large percentage of tasks being performed by the messaging module 402 rather than being performed by the display module 404, requirements, complexity and cost of the display module 404 can be reduced.

FIG. 8 shows a method of operating a display module (e.g., the display module 404 of FIG. 4) of an indication system (e.g., the indication system 400 of FIG. 4). Although the following tasks are primarily described with respect to the implementations of FIGS. 4-6, the tasks may be easily modified to apply to other implementations of the present disclosure. The tasks may be iteratively performed. Although the following tasks 652-660 are shown, one or more of the tasks may not be performed. The display module 404 may be an active and/or smart device and performs the below described tasks. The display module 404 may transfer, originate, and/or generate indication signals and provide the indication signals to the LED 408 independent of and/or without receiving any signals from the messaging module 402.

The method may begin at 650. At 652, the display module 404 determines whether column data received from the messaging module is valid. This may include determining whether the column data is associated with illuminating only one or more LEDs from a single column. If the column data is associated with illuminating LEDs in multiple columns at the same time, the column data may be deemed invalid. As another example, if the column data does not allow for any LEDs to be illuminated for a predetermined period of time, then the column data may be deemed invalid. If valid, task 654 is performed, otherwise task 662 is performed.

At 654, the display module 404 may determine whether an indication signal has successfully been received from the messaging module 402. If an indication signal has been received, task 656 may be performed, otherwise task 660 may be performed.

At 656, the display module 404 may determine an illumination pattern for the indication signal, if not provided in the indication signal. The display module 404 may generate an illumination pattern signal to illuminate the LED 408 according to the illumination pattern. The illumination pattern may be generated based on the data provided in the indication signal. At 658, the indication signal and/or the illumination pattern signal may be provided to the LED 408. The indication signal and/or illumination pattern signal may be a positive status and/or diagnostic signal. Tasks 656 and 658 may be performed independent of receiving an indication signal from the messaging module 402. At 660, the display module 404 displays the message on the display 406, as described above.

At 662, the display module 404 may determine whether an indication signal has successfully been received from the messaging module 402. If an indication signal has been received, task 664 may be performed, otherwise task 670 may be performed.

At 664, the display module 404 may generate an error indication signal and/or error illumination pattern for the invalid column data. At 666, the display module 404 may determine an illumination pattern for the received indication signal if not already provided in the received indication signal. At 668, the display module 404 may indicate the error indication signal and the received indication signal via the LED 408.

At 670, the display module 404 may generate an error indication signal for not receiving a valid message and/or an indication signal from the messaging module 402 and/or for not receiving a message and/or indication signal from the messaging module 402 for a predetermined period of time. At 672, the display module 404 may display the error indication signal via the LED 408. Task 652 may be performed subsequent to each of tasks 660, 668, 672.

The above-described tasks of FIGS. 7-8 are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Some or all hardware features of a module may be defined using a language for hardware description, such as IEEE Standard 1364-2005 (commonly called "Verilog") and IEEE Standard 1076-2008 (commonly called "VHDL"). The hardware description language may be used to manufacture and/or program a hardware circuit. In some implementations, some or all features of a module may be defined by a language, such as IEEE 1666-2005 (commonly called "SystemC"), that encompasses both code, as described below, and hardware description.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An indication system comprising:

an evaluation module configured to generate a message based on a parameter of a compressor or a drive of the compressor;

a messaging module configured to generate a first message based on the parameter, generate a string of glyphs based on the first message, select a predetermined number of glyphs in the string of glyphs, generate column data for the selected predetermined number of glyphs, and generate packets including the column data;

a display module configured to (i) receive the packets via an interface, and (ii) generate output signals based on the packets; and a display comprising an array of light emitting diodes (LEDs), wherein the display does not include a transistor, wherein the display is configured to receive the output signals and illuminate the LEDs of the display based on the output signals, and wherein the display module is configured to generate the output signals to illuminate one or more of the LEDS of the display in a column-by-column format, such that power is only provided to one column of the array of LEDs at any moment in time.

2. The indication system of claim 1, further comprising a LED separate from the display, wherein the display module is configured to provide an indication signal to the LED separate from the display.

3. The indication system of claim 2, wherein the indication signal indicates an error or fault with the compressor or the drive.

4. The indication system of claim 2, wherein the indication signal indicates an error or fault corresponding to the first message.

5. The indication system of claim 2, wherein the messaging module is configured to originate the indication signal.

6. The indication system of claim 2, wherein the display module is configured to originate the indication signal.

7. The indication system of claim 1, wherein:

the messaging module is configured to generate a first indication signal based on status of the compressor or the drive of the compressor; and the display module is configured to determine whether the column data is valid, generate a second indication signal if the column data is invalid, and provide the first indication signal and the second indication signal to the LED separate from the display.

8. The indication system of claim 1, wherein the messaging module includes a processor.

9. The indication system of claim 1, wherein the display module includes a field programmable gate array.

10. The indication system of claim 1, wherein:

the messaging module is implemented as a processor; and the display module is implemented as a field programmable gate array.

11. The indication system of claim 10, wherein:

the array of LEDs is a 5-by-7 array of LEDs; and the display module is configured to display portions of up to 3 glyphs on the array of LEDs at any moment in time.

12. The indication system of claim 10, wherein:

the field programmable gate array has 240 or 570 logic elements;

the display module refreshes states of the LEDs in the array of LEDs at a refresh rate of 1000 kHz; and the display module provides the column data to the display column-by-column and at a predetermined load rate of 8-10 Hz.

13. The indication system of claim 1, wherein the messaging module comprises:

a string generator configured to (i) generate the string of glyphs based on the first message, and (ii) store the string of glyphs in a first first-in-first-out queue;

a multi-glyph selector configured to (i) select the predetermined number of glyphs in the string of glyphs, and (ii) store the predetermined number of glyphs in a second first-in-first-out queue;

a glyph-to-column converter configured to (i) generate the column data for the selected predetermined number of glyphs, and (ii) store the column data in a third first-in-first-out queue; and a forwarding module configured to (i) generate the packets including the column data, and (ii) forward the packets to the display module.

14. The indication system of claim 1, wherein:

the messaging module is configured to (i) generate a plurality of messages based on parameter data, status information, error or fault information, diagnostic data and software version information, and (ii) generate packets comprising the plurality of messages, wherein the plurality of messages include the first message, and wherein the parameter data, status information, error or fault information, diagnostic data and software version information corresponds to operation of the compressor or the drive of the compressor; and the display module is configured to, based on the packets, generate a plurality of output signals for row and column control lines of the display to display the plurality of messages in a predetermined order.

15. A method of operating an indication system, the method comprising:

generating a message based on a parameter of a compressor or a drive of the compressor;

generating a first message based on the parameter at a messaging module;

generating a string of glyphs based on the first message;

selecting a predetermined number of glyphs in the string of glyphs;

generating column data for the selected predetermined number of glyphs;

generating packets including the column data;

receiving the packets at a display module via an interface;

generating output signals based on the packets; and receiving the output signals at a display and illuminating an array of light emitting diodes (LEDs) of the display based on the output signals, wherein the display does not include a transistor, wherein the output signals are generated to illuminate one or more of the LEDS of the display in a column-by-column format, such that power is only provided to one column of the array of LEDs at any moment in time.

16. The method of claim 15, further comprising providing an indication signal to an LED separate from the display, wherein the indication signal indicates an error with the compressor, the drive or the first message, and wherein the indication signal originated at the messaging module or the display module.

17. The method of claim 15, further comprising:

generating at the messaging module a first indication signal based on status of the compressor or the drive of the compressor;

determining at the display module whether the column data is valid;

generating a second indication signal if the column data is invalid; and providing the first indication signal and the second indication signal to the LED separate from the display.

18. The method of claim 15, wherein:

the messaging module is implemented as a processor;

the display module is implemented as a field programmable gate array;

the array of LEDs is a 5-by-7 array of LEDs; and the display module is configured to display portions of up to 3 glyphs on the array of LEDs at any moment in time.

19. The method of claim 18, wherein:

the field programmable gate array has 240 or 570 logic elements;

the display module refreshes states of the LEDs in the array of LEDs at a refresh rate of 1000 kHz; and the display module provides the column data to the display column-by-column and at a predetermined load rate of 8-10 Hz.

20. The method of claim 15, further comprising:

generating a plurality of messages based on parameter data, status information, error or fault information, diagnostic data and software version information;

generating packets comprising the plurality of messages, wherein the plurality of messages include the first message, and wherein the parameter data, status information, error or fault information, diagnostic data and software version information corresponds to operation of the compressor or the drive of the compressor; and based on the packets, forwarding the plurality of messages to be displayed on the display in a predetermined order.

* * * * *